US008302418B2

(12) United States Patent
Nakajima

(10) Patent No.: US 8,302,418 B2
(45) Date of Patent: Nov. 6, 2012

(54) INDOOR UNIT AND AIR CONDITIONING SYSTEM WITH FAULTY WIRING DISCRIMINATION

(75) Inventor: Seiji Nakajima, Takasaki (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 1076 days.

(21) Appl. No.: 12/239,285

(22) Filed: Sep. 26, 2008

(65) Prior Publication Data

US 2009/0077990 A1 Mar. 26, 2009

(30) Foreign Application Priority Data

Sep. 26, 2007 (JP) ..... 2007-248465

(51) Int. Cl.

| | |
|---|---|
| ***F25D 19/00*** | (2006.01) |
| ***F25B 49/00*** | (2006.01) |
| ***G08B 1/08*** | (2006.01) |
| ***H02J 1/00*** | (2006.01) |
| ***G01R 1/20*** | (2006.01) |
| ***G05B 23/00*** | (2006.01) |

(52) U.S. Cl. ..... 62/259.1; 62/132; 340/539.11; 307/1; 307/3; 307/42; 307/147; 307/154; 700/276; 236/51

(58) Field of Classification Search ..... 62/259.1; 340/539.11; 307/1, 3, 42, 147, 154; 700/276
See application file for complete search history.

(56) References Cited

U.S. PATENT DOCUMENTS

| | | | | |
|---|---|---|---|---|
| 6,290,141 | B1 * | 9/2001 | Park et al. | 236/51 |
| 6,625,996 | B2 * | 9/2003 | Nakajima et al. | 62/175 |
| 6,647,735 | B2 * | 11/2003 | Street et al. | 62/132 |
| 6,711,445 | B1 * | 3/2004 | Heath et al. | 700/3 |
| 6,777,954 | B2 * | 8/2004 | Yamada et al. | 324/543 |
| 6,865,898 | B2 * | 3/2005 | Yamanashi et al. | 62/132 |
| 7,523,619 | B2 * | 4/2009 | Kojima et al. | 62/132 |
| 2001/0054291 | A1 * | 12/2001 | Roh et al. | 62/126 |

FOREIGN PATENT DOCUMENTS

| | | |
|---|---|---|
| JP | 06-147616 A | 5/1994 |
| JP | 08-035715 A | 2/1996 |
| JP | 08-303842 | 11/1996 |
| WO | 2005-039069 A1 | 4/2005 |

OTHER PUBLICATIONS

Japanese Office Action dated Oct. 18, 2011, issued in corresponding Japanese Patent Application No. 2007-248465 with an English translation.

* cited by examiner

*Primary Examiner* — Marc Norman
*Assistant Examiner* — Filip Zec
(74) *Attorney, Agent, or Firm* — Westerman, Hattori, Daniels & Adrian, LLP

(57) ABSTRACT

An air conditioning system comprising an outdoor and an indoor unit connected through common power supply lines. The outdoor unit including a first communication circuit using one of the plurality of common power supply lines and one signal line independent of the power supply lines. The indoor unit comprising terminals connected to the first communication circuit; a switch configured to set the first and second communication circuits to a connection state or a disconnection state; a detection circuit configured to detect a voltage between the terminals; and a controller configured to control the switch. The switch sets the first and second communication circuits to the disconnection state when the voltage detected by the detection circuit equals or exceeds a predetermined threshold value; otherwise the switch sets the first and second communication circuits to the connection state.

4 Claims, 10 Drawing Sheets

FIG. 6

| | | No. 1 | No. 2 | No. 3 | No. 4 | No. 5 | No. 6 |
|---|---|---|---|---|---|---|---|
| CONNECTION STATE | SG TERMINAL | SG | SG | S1 | S1 | R1 | R1 |
| | S1 TERMINAL | S1 | R1 | SG | R1 | SG | S1 |
| | R1 TERMINAL | R1 | S1 | R1 | SG | S1 | SG |
| OPERATION STATE | INTER-RESISTOR VOLTAGE | DC24V | AC200V | 0V | AC200V | AC200V | AC200V |
| | CONTROLLER OPERATION | OK | OK | OK | OK | NG | NG |
| | SWITCH STATUS | ON | OFF | ON | OFF | OFF | OFF |
| | COMMUNICATION STATE | OK | — | NG | — | — | — |
| | JUDGMENT | NORMAL | FAULTY WIRING | FAULTY WIRING or COMMUNICATION ERROR | FAULTY WIRING | FAULTY WIRING | FAULTY WIRING |

INDOOR UNIT AND AIR CONDITIONING SYSTEM WITH FAULTY WIRING DISCRIMINATION

CLAIM OF PRIORITY

The present application claims the benefit of priority, under 35 U.S.C. §119, of Japanese Patent Application No. 2007-248465 filed on Sep. 26, 2007, the content of which is incorporated herein by reference in its entirety.

FIELD OF THE INVENTION

The present invention relates to an indoor unit and an air conditioning system using the same.

BACKGROUND OF THE INVENTION

There is known an air conditioning system in which information is exchanged between an indoor unit and an outdoor unit by serial communication as disclosed in JP-A-08-303842. In some cases, a power supply line which is commonly used between the indoor unit and the outdoor unit is used as a communication line for transmitting serial signals. More specifically, in such an air conditioning system, one of the power supply lines and one signal line independent of the power supply lines are used as a communication line to perform communications.

In the air conditioning system using the power supply line as described above, it is necessary to perform wiring with no error while discriminating a power supply line used as a communication line from the other power supply lines. However, when wiring is performed without the discrimination and thus faulty wiring occurs, some trouble may occur in the communication circuit at the indoor unit side.

SUMMARY OF THE INVENTION

In one aspect, the present invention provides an air conditioning system comprising an outdoor unit and an indoor unit, the outdoor unit and indoor unit being connected to each other through a plurality of common power supply lines, the outdoor unit including a first communication circuit configured to perform communication by using, as communication lines, at least one of the plurality of common power supply lines and at least one signal line independent of the power supply lines the indoor unit comprising, a pair of terminals to which the communication lines from the first communication circuit are connected; a second communication circuit that is connected to the pair of terminals, and which communicates with the first communication circuit; a switch configured to set the first communication circuit and the second communication circuit to a connection state or a disconnection state; a detection circuit configured to detect a voltage appearing between the pair of terminals; and a controller configured to control the switch, wherein the switch is controlled to set the first communication circuit and the second communication circuit to the disconnection state when an occurrence of faulty wiring is estimated, wherein the occurrence of faulty wiring is estimated when the voltage detected by the detection circuit equals or exceeds a predetermined threshold value; and the controller further configured to control the switch to otherwise set the first communication circuit and the second communication circuit to the connection state.

In another aspect, the present invention provides an indoor unit connected through common power supply lines to an outdoor unit having a first communication circuit which communicates with the indoor unit by using as communication lines one of the power supply lines and one signal line independent of the power supply lines, the indoor unit comprising a pair of terminals to which the communication lines from the first communication circuit are connected; a second communication circuit that is connected to the pair of terminals and which communicates with the first communication circuit; a switch configured to set the first communication circuit and the second communication circuit to a connection state or a disconnection state; a detection circuit configured to detect a voltage appearing between the pair of terminals; and a controller configured to control the switch to set the first communication circuit and the second communication circuit to the connection state when the voltage detected by the detection circuit is equal to or greater than a predetermined threshold value; and the controller further configured to control the switch to set the first communication circuit and the second communication circuit to the disconnection state when the detection voltage is less than the predetermined threshold.

BRIEF DESCRIPTION OF THE INVENTION

FIG. 6 is a diagram showing the relationship between a connection state and an operation state;

DETAILED DESCRIPTION OF ILLUSTRATIVE EMBODIMENTS

Figure 1:
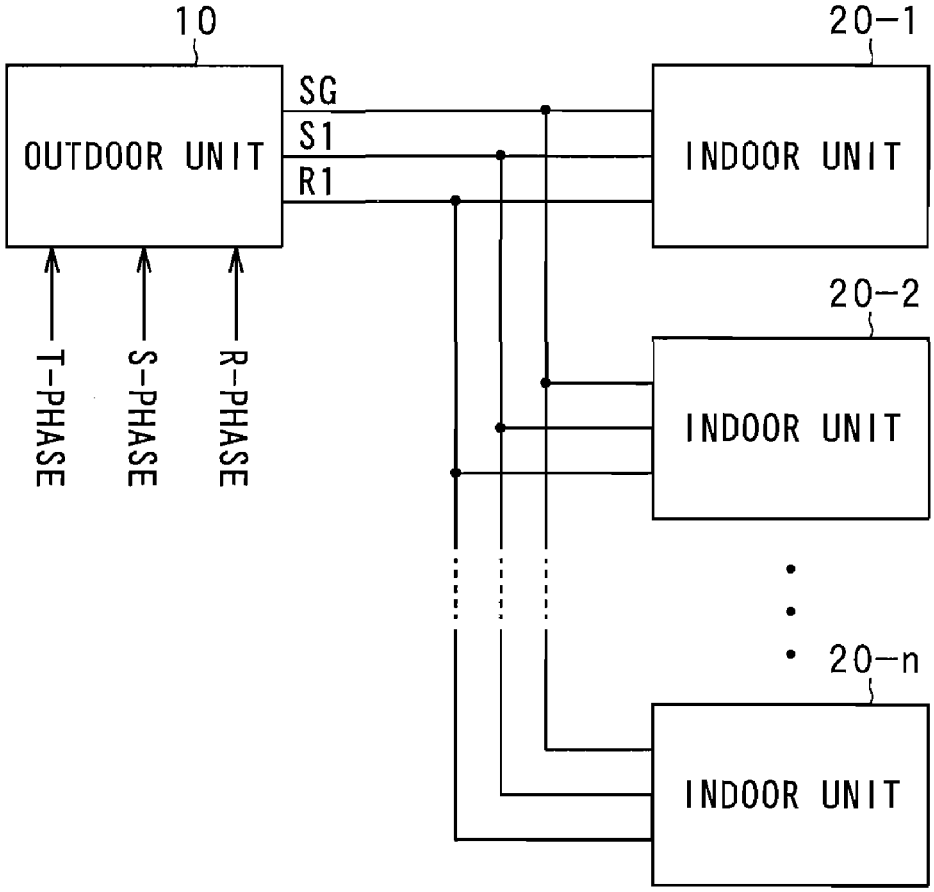
FIG. 1 is a schematic diagram showing the construction of an air conditioning system according to a first embodiment of the present invention.

By way of overview and introduction, an embodiment of the invention provides an air conditioning system and an indoor unit in which no trouble occurs even when faulty wiring occurs.

According to a first aspect of the present invention, in an air conditioning system in which an outdoor unit and an indoor unit are connected to each other through common power supply lines, the outdoor unit has a first communication circuit for performing communications by using as communication lines one of the power supply lines and one signal line independent of the power supply lines, and the indoor unit has a pair of terminals to which the communication lines from the first communication circuit are connected, a second communication circuit that is connected to the pair of terminals and communicates with the first communication circuit, a switch for setting the first communication circuit and the second communication circuit to a connection state or a disconnection state, a detection circuit for detecting a voltage appearing between the pair of terminals, and a controller for controlling the switch to set the first communication circuit and the second communication circuit to the disconnection state because occurrence of faulty wiring is estimated when the voltage detected by the detection circuit is equal to a predetermined threshold value or more or set the first communication circuit and the second communication circuit to the connection state in the other cases.

According to the air conditioning system described above, the voltage appearing at (between) the pair of terminals is detected by the detection circuit. If the detected voltage is above the predetermined threshold value, the controller controls the switch to set the first and second communication circuits to the disconnection state (that is, the controller sets the switch to the disconnection state), and in the other cases, the controller controls the switch to set the first and second communication circuits to the connection state (that is, the controller sets the switch to the connection state). Therefore, even when faulty wiring occurs, no trouble occurs.

In the above air conditioning system, the indoor unit is further equipped with a judging circuit for judging whether communication can be performed between the outdoor unit and the indoor unit when the controller controls the switch to set the first and second communication circuits to the connection state.

According to the above air conditioning system, when the switch is set to the connection state, it is judged whether the communication can be performed between the indoor unit and the outdoor unit. Therefore, when no faulty wiring occurs, it is subsequently judged whether communication can be performed or not.

Furthermore, in the above air conditioning system, the indoor unit is further equipped with a presentation circuit for presenting a detection result of the detection circuit and a judgment result of the judging circuit.

According to the above air conditioning system, the detection result of the detection circuit and the judgment result of the judging circuit are presented. Therefore, the presence or absence of the faulty wiring and whether communications can be performed or not can be known on the basis of the information presented by the presentation circuit.

In the above air conditioning system, the switch sets the first and second communication circuits to the connection state when no driving voltage is applied from the controller, or sets the first and second communication circuits to the disconnection state when a driving voltage is applied from the controller.

According to the above air conditioning system, when the driving voltage is applied, the switch is set to the connection state, so that the first and second communication circuits are set to the connection state. Therefore the first and second communication circuits are not set to the connection state unless the driving voltage is supplied. Accordingly, when faulty wiring occurs, the second communication circuit can be prevented from being damaged by malfunction.

According to a second aspect of the present invention, an indoor unit connected through common power supply lines to an outdoor unit having a first communication circuit which communicates with the indoor unit by using as communication lines one of the power supply lines and one signal line independent of the power supply lines, includes: a pair of terminals to which the communication lines from the first communication circuit are connected; a second communication circuit that is connected to the pair of terminals and communicates with the first communication circuit; a switch for setting the first communication circuit and the second communication circuit to a connection state or a disconnection state; a detection circuit for detecting a voltage appearing between the pair of terminals; and a controller for controlling the switch to set the first communication circuit and the second communication circuit to the connection state when the voltage detected by the detection circuit is equal to a predetermined threshold value or more or set the first communication circuit and the second communication circuit to the disconnection state in the other cases.

According to the above-described indoor unit, the voltage appearing at (between) the pair of terminals is detected by the detection circuit. If the detected voltage is above the predetermined threshold value, the controller controls the switch to set the first and second communication circuits to the disconnection state (that is, the controller sets the switch to the disconnection state), and in the other cases, the controller controls the switch to set to the first and second communication circuits to the connection state (that is, the controller sets the switch to the connection state). Therefore, even when faulty wiring occurs, no trouble occurs.

Preferred embodiments according to the present invention will be described hereunder with reference to the accompanying drawings.

Construction of First Embodiment

FIG. 1 is a diagram showing the construction of a first embodiment of the present invention. As shown in FIG. 1, in the first embodiment of the present invention, an outdoor unit 10 and indoor units 20-1 to 20-n are connected to one another through power supply lines S1, R1 and one signal line (SG) independent of the power supply lines. The power supply line S1 is also used as a communication line, and information is received/transmitted between the outdoor unit 10 and each of the indoor units 20-1 to 20-n by serial communication while the power supply line S1 and the signal line SG serve as communication lines. The outdoor unit 10 is supplied with 3-phase AC power of T-phase, S-phase and R-phase, and the indoor units 20-1 to 20-n are supplied with the power of S-phase and R-phase by the power supply lines S1, R1.

Figure 2:
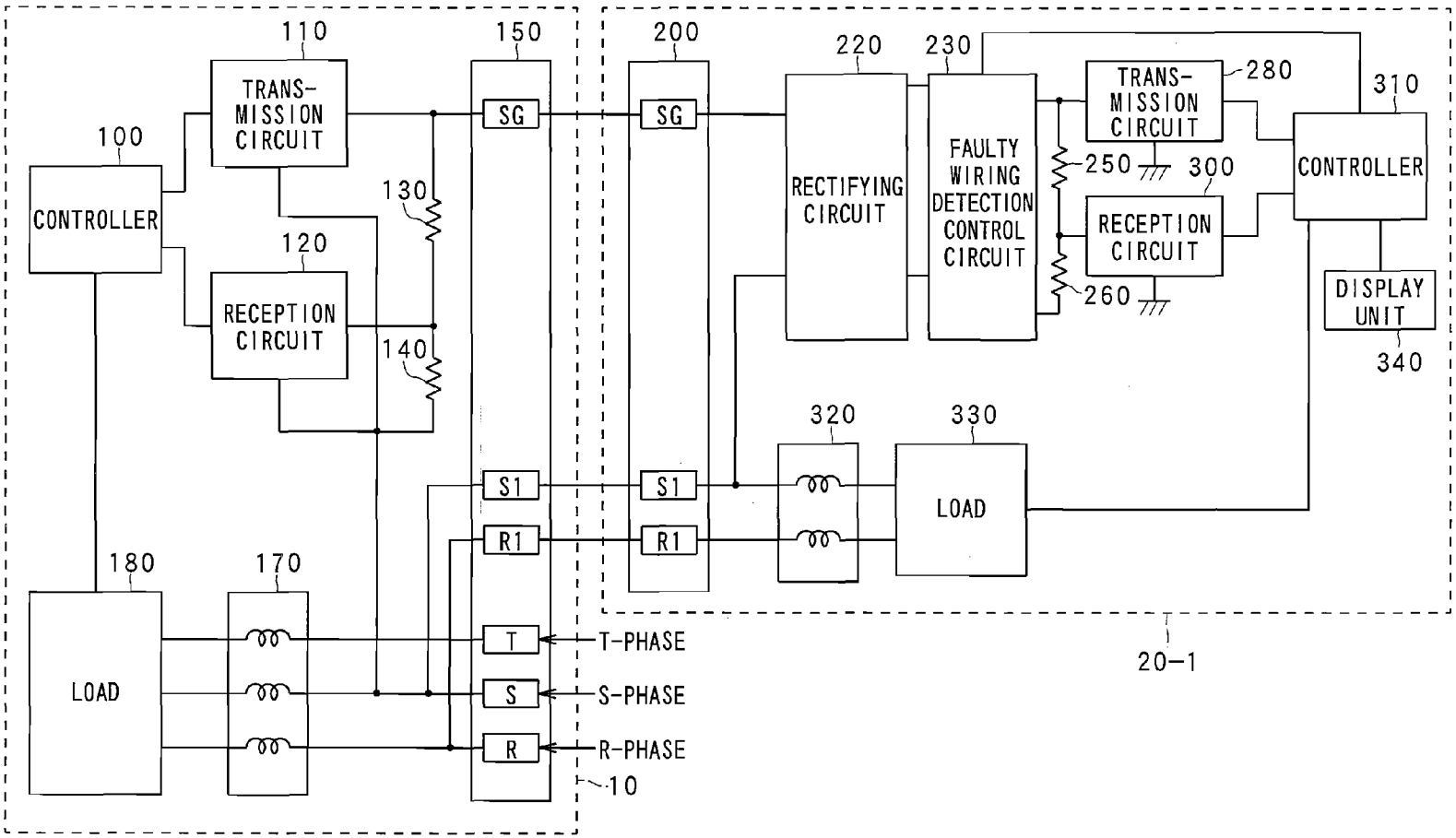
FIG. 2 is a block diagram showing the construction shown in FIG. 1.

FIG. 2 is a block diagram showing an example of the electrical construction of the outdoor unit 10 and the indoor unit 20-1. The indoor units 20-1 to 20-n have the same construction, and thus the indoor unit 20-1 is representatively described in the following description. As shown in FIG. 2, the outdoor unit 10 comprises a controller 100, a transmission circuit 110 (corresponding to "first communication circuit" in claims), a reception circuit 120 (corresponding to "first communication circuit" in claims), resistors 130, 140, a terminal table 150, a noise filter 170 and a load 180 as main constituent elements.

Here, the controller 100 is constructed by CPU (Central Processing Unit), ROM (Read Only Memory), RAM (Random Access Memory), etc., and it communicates with the indoor units 20-1 to 20-n through the transmission circuit 110 and the reception circuit 120, and also controls the load 180, etc. on the basis of the communication result. The transmission circuit 110 generates a serial signal on the basis of data supplied from the controller 100, and transmits the serial signal to the indoor units 20-1 to 20-n through the terminal table 150. The reception circuit 120 receives the serial signals transmitted from the indoor unit 20-1 to 20-n to restore the serial signals to original data, and then supplies these data to the controller 100. Resistors 130, 140 function as input/output resistors of the transmission circuit 110 and the reception circuit 120. The terminal table 150 has terminals SG, S1, R1, T, R, S, the signal line SG is connected to the terminal SG, the power supply lines S1, R1 are connected to the terminals S1, R1, and three-phase AC power supply lines (the lines corresponding to the T-phase, the S-phase and the R-phase in FIG. 2) are connected to the terminals T, R and S, respectively.

A noise filter 170 is a filter for removing or attenuating noise superposed on the three-phase AC power supply, and it is constructed by a low pass filter, for example. The load 180 is constructed by a compressor for compressing refrigerant, an air blowing fan, a stepping motor for controlling an outdoor expansion valve, etc., for example.

As shown in FIG. 2, the indoor unit 20-1 mainly comprises a terminal table 200, a rectifying circuit 220, a faulty wiring detection control circuit 230, resistors 250, 260, a transmission circuit 280 (corresponding to "second communication circuit" in claims), a reception circuit 300 (corresponding to "second communication circuit" in claims), a controller 310 ("control circuit " and "judging circuit" in claims), a noise filter 320, a load 330 and a display unit 340 ("presentation circuit" in claims).

Here, the terminal table 200 has terminals SG, S1 and R1. The signal SG is connected to the terminal SG (corresponding to "pair of terminals" in claims), the power supply lines S1, R1 are connected to the terminal S1 (corresponding to "pair of terminals" in claims) and the terminal R1, respectively. The rectifying circuit 220 rectifies the serial signal transmitted through the signal line SG and the power supply line S1. The faulty wiring detection control circuit 230 detects faulty wiring and notifies the detection of the faulty wiring to the controller 310. In addition, when no faulty wiring is detected, the faulty wiring detection control circuit 230 sets a built-in switch (described later) to a connection state, whereby the transmission circuit 280 and the reception circuit 300 are connected to the signal line SG and the power supply line S1.

The resistors 250, 260 function as input/output resistors for the transmission circuit 280 and the reception circuit 300. The transmission circuit 280 converts data supplied from the controller 310 to a serial signal and transmits the serial signal. The reception circuit 300 receives the serial signal transmitted from the outdoor unit 10, restores the serial signal to the corresponding data, and supplies the restored data to the controller 310. The controller 310 is constructed by CPU, ROM, RAM, etc., for example, and it communicates with the outdoor unit 10 through the transmission circuit 280 and the reception circuit 300 and also controls the load 330, etc. on the basis of the communication result, etc.

Furthermore, when faulty wiring is detected by the faulty wiring detection control circuit 230, the controller 310 controls the display unit 340 to display the detection of the faulty wiring, and also when no faulty wiring is detected, the controller 310 sets a switch described later to a connection state, thereby making it possible to perform the communication. Furthermore, after the switch is set to the connection state, the controller 310 judges whether the communication can be performed.

The noise filter 320 is disposed between the terminal table 200 and the load 330, and removes or attenuates high-frequency components contained in power supplied from the outdoor unit 10 through the power supply lines S1, R1. The load 330 is constructed by a stepping motor, etc. for driving the air blowing fan and the indoor expansion valve. The display unit 340 is constructed by LED (Light Emitting Diode), etc., for example, it notifies occurrence of faulty wiring or communication error to an installation technician or the like by the turn-on/turn-off state thereof.

Figure 3:
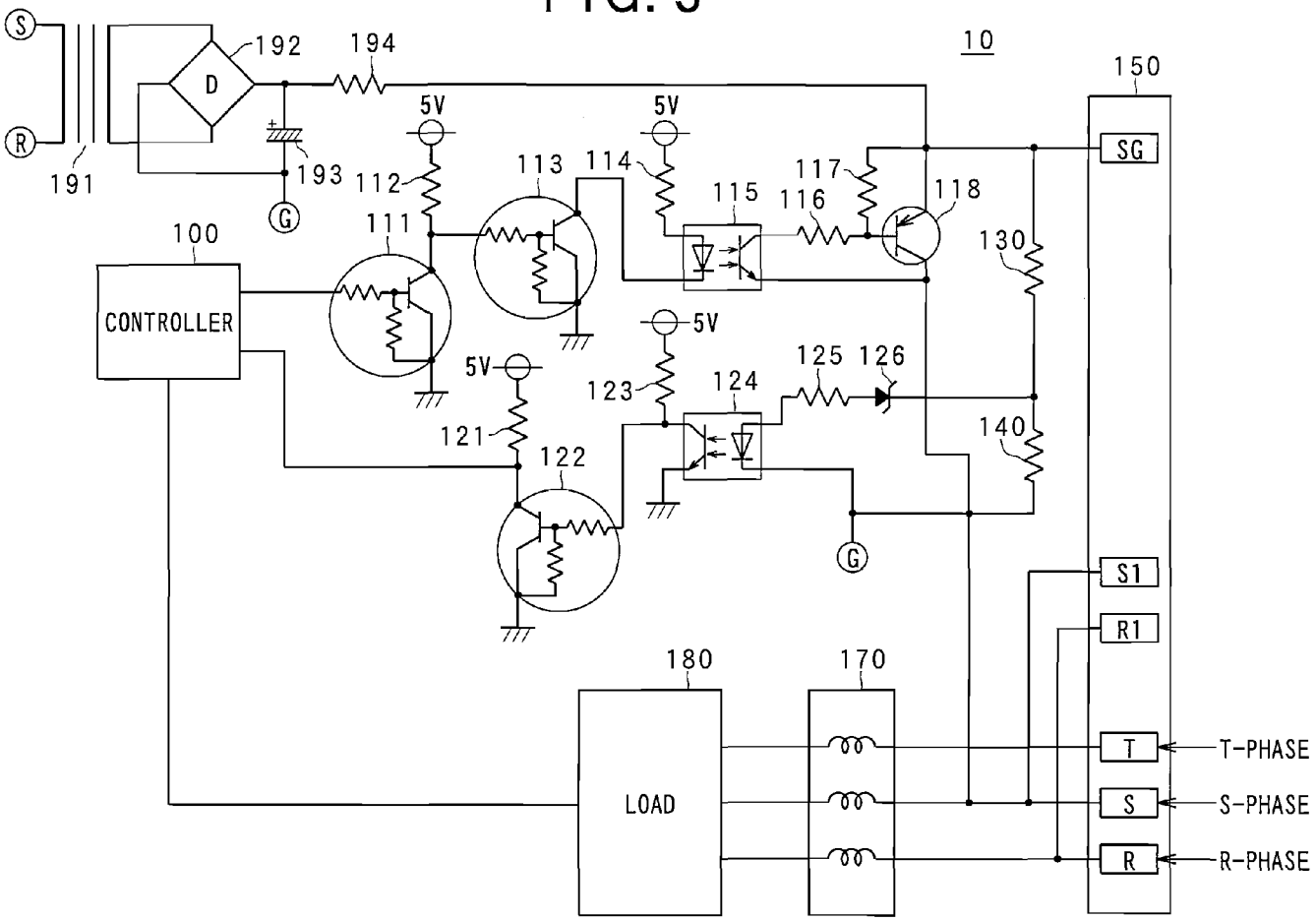
FIG. 3 is a circuit diagram showing an example of the construction of an outdoor unit shown in FIG. 2.

FIG. 3 is a circuit diagram showing the detailed construction of the outdoor unit 10 shown in FIG. 2. As shown in FIG. 3, the outdoor unit 10 mainly comprises a controller 100, transistors 111, 113, 118, 122, resistors 112, 114, 116, 117, 121, 123, 125, 130, 140, photocouplers 115, 124, a zener diode 126, the terminal table 150, the noise filter 170 and the load 180. The emitter of the transistor 118 is supplied with a DC voltage (about 24V) generated by a power supply circuit having a transformer 191, a bridge diode 192, a capacitor 193 and a resistor 194. The minus terminal of the capacitor 193 is connected to the S-phase of the power supply as the ground.

Here, the transistors 111, 113 and 118, the resistors 112, 114, 116 and 117 and the photocoupler 115 constitute the transmission circuit 110. The transistor 122, the resistors 121, 123 and 125, the zener diode 126 and the photocoupler 124 constitute the reception circuit 120.

The transistors 111 and 113 and the resistor 112 constitute a non-inverting amplifying circuit, which amplifies data output from the controller 100 and supplies the amplified data to the photocoupler 115. The photocoupler 115 comprises an LED (Light Emitting Diode) and a photodiode which are installed in the outdoor unit 10. The LED concerned emits light in accordance with current flowing in the collector of the transistor 113, and the photodiode receives this light, converts the light to the corresponding electrical signal and then outputs the electrical signal. The transistor 118 and the resistors 116, 117 switch the power supply voltage supplied from the resistor 194 in accordance with the output of the photocoupler 115, and outputs to both the ends of the resistors 130, 140.

The zener diode 126 has a function of wave-shaping a voltage appearing across the resistor 140. The resistor 125 limits current flowing to the input side of the photocoupler 124. The photocoupler 124 emits light from a built-in LED in accordance with a voltage output from the resistor 125, converts the light to an electrical signal by a built-in photodiode and outputs the electrical signal. The resistor 123 limits current flowing through the photocoupler 124 and the transistor 122. The transistor 122 and the resistor 121 constitutes an inverting amplifying circuit, and it inverts and amplifies the output voltage of the photocoupler 124 and supplies the inverted amplified output to the controller 100.

Figure 4:
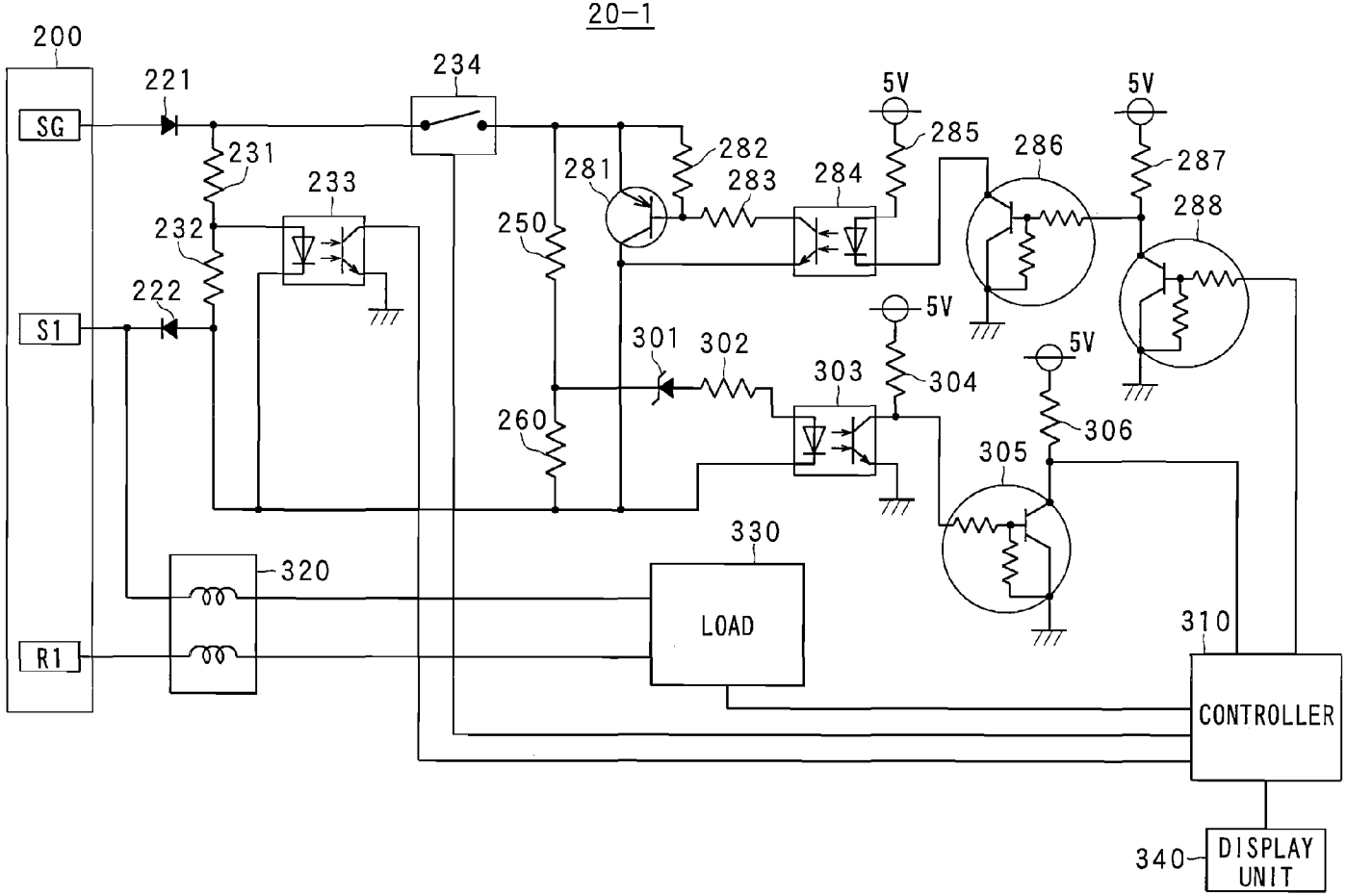
FIG. 4 is a circuit diagram showing an example of the construction of an indoor unit shown in FIG. 2.

FIG. 4 is a circuit diagram showing the detailed construction of the indoor unit 20-1 shown in FIG. 2.

As shown in FIG. 4, the indoor unit 20-1 mainly comprises a terminal table 200, diodes 221, 222, resistors 231, 232, 250, 260, 282, 283, 285, 287, 302, 304 and 306, transistors 281, 286, 288 and 305, photocouplers 233, 284 and 303, a switch 234, a zener diode 301, a controller 310, a noise filter 320, a load 330 and a display unit 340. The diodes 221, 222 constitutes a rectifying circuit 220. The resistors 231, 232, the photocoupler 233 (corresponding to "detection circuit" in claims) and the switch 234 (corresponding to "switch" in claims) constitute a faulty wiring detection control circuit 230. The transistors 281, 286, 288, the resistors 282, 283, 285, 287 and the photocoupler 284 constitute the transmission circuit 280. The transistor 305, the resistors 302, 304, 306, the zener diode 301 and the photocoupler 303 constitute the reception circuit 300.

Here, the resistors 231 and 232 divide the voltage occurring between the cathode of the diode 221 and the anode of the diode 222, and supplies the divided voltage to the input side of the photocoupler 233. The voltage dividing ratio is set so that the photocoupler 233 is set to OFF-state when DC 24V which is a normal voltage of the serial signal is applied between the terminal SG and the terminal S1 and the photocoupler 233 is set to ON-state when AC 200V which is an abnormal voltage due to faulty wiring is applied therebetween. Since a voltage of about 200V is applied to the resistors 231, 232 in the case of faulty wiring, it is desired to use resistors having a high withstanding voltage (Wattage) (for example, several watts). The switch 234 is constructed by an electromagnetic relay, for example, and it is set to ON-state when a driving voltage is supplied from the controller 310 or to OFF-state when no driving voltage is supplied.

The transistors 288, 286 and the resistor 287 constitutes a non-inverting amplifying circuit, and it amplifies a signal output from the controller 310 and supplies the amplified signal to the photocoupler 284. The photocoupler 284 emits light from a built-in LED in accordance with current flowing in the collector of the transistor 286, converts the light from LED to the corresponding electrical signal by the photodiode, and outputs the electrical signal. The transistor 281 amplifies the output of the photocoupler 284, and outputs the amplified output to the resistors 250, 260.

The zener diode 301 shapes the waveform of the voltage appearing at the resistor 260 and outputs the waveform-shaped voltage. The resistor 302 limits current flowing into the input terminal of the photocoupler 303. The photocoupler 303 generates light from a built-in LED in accordance with the current flowing through the resistor 302, and outputs the voltage corresponding to the intensity of the light from a built-in photodiode. The transistor 305 and the resistor 306 constitutes an inverting amplifying circuit, and it inverts the output of the photocoupler 303 and outputs the inverted output to the controller 310.

The noise filter 320 is disposed between the terminal table 200 and the load 330, and removes or attenuates the high frequency components contained in the power supplied from the outdoor unit 10 through the power supply line. The load 330 is constructed by a stepping motor for driving the air blowing fan and the indoor expansion valve, etc.

Operation of First Embodiment

Figure 5:
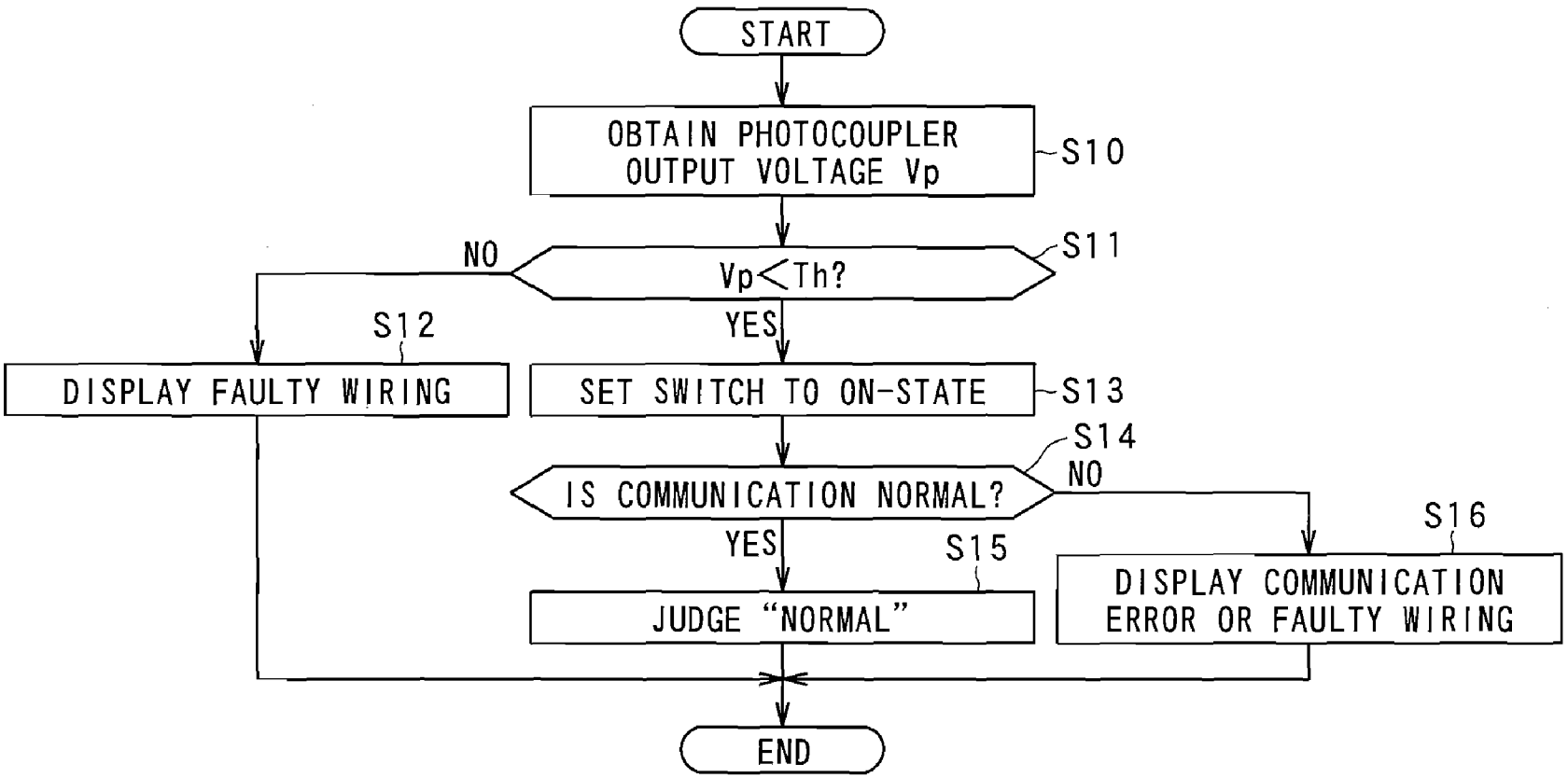
FIG. 5 is a flowchart executed in the indoor unit shown in FIG. 4.

Next, the operation of the first embodiment according to the present invention will be described. FIG. 5 is a flowchart showing an example of the processing executed by the controller of each indoor unit in the embodiment shown in FIG. 2. The indoor units 20-1 to 20-n execute the same operation, and thus the following description will be made by using the indoor unit 20-1 typically.

When the installation of the outdoor unit 10 and the indoor units s20-1 to 20-n is completed, the wiring of the power supply lines S1 and R1 and the signal line SG is finished and an installation technician turns on the power of the outdoor unit, the three-phase AC power supplied to the outdoor unit 10 is supplied to each part of the outdoor unit 10, and also supplied to each of the indoor units 20-1 to 20-n through the power supply lines S1, R1. When a normal power supply voltage is applied to the terminals S1, R1 of the terminal table 200, the controller 310 starts to operate because the power supply voltage is supplied to the controller 310. When the controller 310 starts to operate, it reads out a program from ROM (not shown) and executes the program concerned. Accordingly, the processing shown in the flowchart of FIG. 5 is started. When the processing of the flowchart is started, the controller 310 first obtains the output voltage Vp of the photocoupler 233 of the faulty wiring detection control circuit 230 (step S10).

Here, the relationship between the wiring state and the voltage input to the photocoupler 233 will be described with reference to FIG. 6. In FIG. 6, first to third lines except for the title portion in the table of FIG. 6 represent the connection state of the respective terminals of the terminal table 200 and the power supply lines and the signal line. Specifically, the first column "No. 1" represents a normal connection state, and it shows the state that the signal line SG is connected to the terminal SG of the terminal table 200, the power supply line S1 is connected to the terminal S1 and the power supply line R1 is connected to the terminal R1. In this case, DC 24V which is a normal serial signal voltage is applied between both the ends of the resistors 231, 232 (between the cathode of the diode 221 and the anode of the diode 222) as shown on the fourth line.

"No. 2" to "No. 6" show faulty wiring states. More specifically, "No. 2" represents the state that the signal line SG is connected to the terminal SG of the terminal table 200, the power supply line R1 is connected to the terminal S1 and the power supply line S1 is connected to the terminal R1. In this case, AC 200V appears between the resistors 231, 232. More specifically, the voltage (about 200V) corresponding to the addition of the DC 24V applied between the power supply line S1 and the signal line SG and AC 200V applied between the power supply terminal S1 and the power supply line R1 appears. Furthermore, "No. 3" represents the state that the power supply line S1 is connected to the terminal SG of the terminal table 200, the signal line SG is connected to the terminal S1 and the power supply line R1 is connected to the terminal R1. In this case, 0V appears between the resistors 231 and 232. More specifically, the connection states to the terminal SG and the terminal S1 are inverted, and thus the polarity of the signal is inverted, so that the diodes 221 and 222 are set to a reverse bias state. Therefore, the voltage appearing between both the ends of the resistors 231 and 232 is equal to 0V.

"No. 4" represents the state that the power supply line S1 is connected to the terminal SG of the terminal table 200, the power supply line R1 is connected to the terminal S1 and the signal line SG is connected to the terminal R1. In this case, AC 200V appears between the resistors 231 and 232. "No. 5" represents the state that the power supply line R1 is connected to the terminal SG of the terminal table 200, the signal line SG is connected to the terminal S1 and the power supply line S1 is connected to the terminal R1. In this case, AC 200V appears between the resistors 231 and 232. Furthermore, "No. 6" represents the state that the power supply line R1 is connected to the terminal SG of the terminal table 200, the power supply line S1 is connected to the terminal S1 and the signal line SG is connected to the terminal R1. In this case, AC 200V appears between the resistors 231 and 232.

As described above, the element value (voltage dividing ratio) of the resistors 231, 232 is set so that the photocoupler 233 is set to the operation state when AC 200V is applied to the resistors 231, 232 and also set to the non-operation state when DC 24V or less is applied to the resistors 231, 232. Accordingly, in the example of FIG. 6, the photocoupler 233 is set to the non-operation state in the case of "No. 1" in which the inter-resistor voltage is equal to DC 24V and in the case of "No. 3" in which the inter-resistor voltage is equal to 0V, and the photocoupler 233 is set to the operation-state in the other cases ("No. 2" and "No. 4" to "No. 6").

As shown on the fifth line of FIG. 6, in the cases of "NO. 1" to "No. 4", the power supply voltage is supplied to the controller 310, and thus the controller 310 is set to the operation state in these cases. On the other hand, in the cases of "No. 5" and "No. 6", DC 24V is applied between the terminal S1 and the terminal R1, and thus the controller 310 is not operated. Therefore, in these cases, the processing of FIG. 5 is not executed.

As a result, in the step S10, in the case that the connection state is set to "No. 2" and "No. 4", a prescribed voltage Vp is output from the photocoupler 233, and thus this voltage Vp is obtained. In the cases of "No. 1" and "No. 3", the output of the photocoupler 233 is equal to 0V, for example, and thus 0V is obtained.

In step S11, the controller 310 judges whether the obtained voltage Vp is less than a predetermined threshold value Th ($Vp<Th$). If $Vp<Th$ (step S11; Yes), the processing goes to step S13. In the other cases (step S11; No), the processing goes to step S12.

In step S12, the controller 310 displays occurrence of faulty wiring on the display unit 340 because it is estimated that faulty wiring occurs. More specifically, in the case of Vp>Th, this case is estimated to correspond to the cases of "No. 2" and "No. 4" shown in FIG. 6. Therefore, a predetermined LED (for example, red LED) of the display unit 340 is turned on. Accordingly, the installation technician can known that faulty wiring occurs.

In step S13, the controller 310 sets the switch 234 to ON-state. More specifically, the controller 310 supplies the switch 234 with a driving signal, and sets the switch 234 to ON-state. As a result, the cathode of the diode 221 and the emitter of the transistor 281 are connected to each other. At this time, the voltage applied between the resistors 231 and 232 is in the normal range (0 to 24V), and thus the circuits subsequent to the transistor 281 are not damaged. As shown on the sixth line of FIG. 6, the switch is set to ON-state in the cases of "No. 1" and "No. 3", and it is set to OFF-state in the cases of "No. 2" and "No. 4" under which AC 200V is applied.

In step S14, the controller 310 judges whether communication is normally performed. If it is normally performed (step S14; Yes), the processing goes to step S15. In the other cases (step S14; No), the processing goes to step S16. More specifically, when a predetermined time (at least a time required until the switches 234 of all the indoor units are set to ON-state) elapses from the power-on of the power source, the controller 100 of the outdoor unit 10 transmits a predetermined signal to the indoor units 20-1 to 20-n, and checks whether communication can be normally performed. More specifically, when the controller 100 supplies data to be transmitted to the transmission circuit 110, and the data supplied from the controller 100 is amplified by the transistors 111, 113 constituting the transmission circuit 110 and supplied o the photocoupler 115. The photocoupler 115 emits light from a built-in LED in accordance with the collector current of the transistor 113 and outputs the voltage corresponding to the intensity of the emitted light from a built-in photodiode. The output of the photocoupler 115 is supplied to the transistor 118. The power (DC 24V) from the transformer 191 is supplied to the transistor 118, and the transistor 118 switches the power supply voltage in accordance with the output of the photocoupler 115 and outputs it to the resistors 130, 140.

The serial signal output from the resistors 130, 140 is supplied to the indoor units 20-1 to 20-n through the signal line SG and the power supply line S1. In the indoor unit 20-1 receiving the serial signal as described above, the reception signal is rectified by the diodes 221, 222, and the obtained signal is applied to the resistors 250, 260 through the switch 234 which is set to ON-state in step S13. The voltage appearing at the resistor 260 is subjected to waveform shaping by the zener diode 301, and then supplied to the photocoupler 303 through the resistor 302. The photocoupler 303 outputs the voltage corresponding to the voltage supplied through the resistor 302, and supplies the voltage to the transistor 305.

The transistor 305 inverts and amplifies the output voltage of the photocoupler 303, and supplies the inverted and amplified voltage to the controller 310. The controller 310 receiving the serial signal recognizes that it receives the signal from the outdoor unit 10, and outputs a signal as an acknowledge to the transistor 288. The transistors 288, 286 amplify the output of the controller 310 and supply the amplified output to the photocoupler 284. The voltage corresponding to the collector current of the transistor 286 is output from the photocoupler 284, and supplied to the transistor 281. The transistor 281 outputs the output voltage corresponding to the output of the photocoupler 284 to the resistors 250, 260. The voltage appearing at the resistors 250, 260 is transmitted to the outdoor unit 10 through the signal line SG and the power supply line S1. The above operation is independently executed in each indoor unit. However, the controller of each indoor unit monitors the states of the signal line SG and the power supply line S1 by the reception circuit, and thus it transmits the acknowledge after it recognizes that no signal is transmitted on the signal line SG and the power supply line S1. Accordingly, signal collision on the signal line SG and the power supply line S1 can be avoided.

The signals transmitted from the indoor unit 20-1 are transmitted to the outdoor unit 10 through the signal line SG and the power supply line S1. In the outdoor unit 10, the voltages of the serial signals supplied from the signal line SG and the power supply line S1 appear at the resistors 130, 140. The voltage (reception signal) appearing at the resistor 140 is subjected to waveform shaping by the zener diode 126, and then supplied through the resistor 125 to the photocoupler 124. The output corresponding to the voltage appearing at the resistor 140 occurs at the output side of the photocoupler 124, and the transistor 122 inverts and amplifies this output voltage and then supplies the inverted and amplified output to the controller 100. The controller 100 receives the output voltage of the transistor 122, and returns it to the original data, thereby recognizing that it is the acknowledge from the indoor unit 20-1.

Through the above operation, the communication between the outdoor unit 10 and the indoor units 20-1 to 20-n is established. When the communication can be normally established, it is judged in step S14 that the communication is normal (step S14; Yes), and then the processing goes to step S15.

In step S15, the controller 310 judges that the wiring is normal, and finishes the processing. At this time, in order to display on the display unit 340 that the communication is normal, for example, a predetermined LED (for example, green LED) may be turned on. The processing goes to step S15 only in the case of "No. 1" in which the lines are normally connected to the terminals as indicated on the seventh line of FIG. 6.

If it is judged in step S14 that the communication is not normal (step S14; No), the processing goes to step S16. In step S16, the controller 310 controls the display unit 340 to display occurrence of a communication error or faulty wiring. More specifically, it is judged in step S14 that the communication is not normal in the case of "No. 3" shown in FIG. 6 or in a case where another failure occurs (for example, when the outdoor unit 10 does not normally operate), and thus the controller 310 turns on a predetermined LED (for example, yellow LED) of the display unit 340 to indicate occurrence of the communication error or faulty wiring. Accordingly, the installation technician can known that the communication error or faulty wiring occurs.

The above processing is executed in all the indoor units 20-1 to 20-n when power is turned on after the installation of the air conditioning system and the wiring work are finished. When the wiring of all the indoor units 20-1 to 20-n is normal, the switches 234 of all the indoor units are kept to ON-state. On the other hand, when faulty wiring occurs, the switch 234 of an indoor unit in which the faulty wiring occurs is set to OFF-state, so that the indoor unit concerned is kept to be separated from the system. Therefore, the system can be prevented from being affected by the indoor unit in which the faulty wiring occurs.

As described above, according to the first embodiment of the present invention, the voltage appearing at (between) the terminals SG and the terminal S1 of the terminal table 200 is detected by the photocoupler 233, and if the output voltage of the photocoupler 233 is above a predetermined threshold value, the switch 234 is not turned on. Accordingly, it can be prevented that an excessive voltage is applied to the transmission circuit 280 and the reception circuit 300 due to faulty wiring and thus the transmission circuit 280 and the reception circuit 300 are damaged.

Furthermore, according to the first embodiment, after the switch 234 is set to ON-state, it is judged whether communication is normal. If the communication is not normal, this fact is displayed on the display unit 340. Accordingly, it can be known that the case of "No. 3" shown in FIG. 6 may occur. Therefore, the installation technician may assess the probability of faulty wiring.

Still furthermore, according to the first embodiment, a switch which is set to ON-sate when a driving signal is supplied from the controller 310 is used as the switch 234. Accordingly, when a normal driving signal is not supplied from the controller 310, the switch 234 is set to OFF-state at all times, and thus a high voltage can be prevented from being erroneously applied to the transmission circuit 280 and the reception circuit 300. Particularly, in the cases of "No. 5" and "No. 6" shown in FIG. 6, the controller 310 does not operate. However, even in these cases, the switch 234 is kept to OFF-state, so that a high voltage can be prevented from being erroneously applied to the transmission circuit 280 and the reception circuit 300.

Construction of Second Embodiment

Next, a second embodiment according to the present invention will be described.

In the first embodiment, as shown in FIG. 1, the outdoor unit 10 and the indoor units 20-1 to 20-n are connected to one another through the signal line SG and the power supply lines s1, R1, and the communication is performed by using the power supply line S1 and the signal line SG. Furthermore, there exists an air conditioning system in which an outdoor unit 11 and indoor units 21-1 to 21-n are connected to one another through power supply lines S1, R1, and also connected to one another through two signal lines SG1 and SG2 independent of the power supply lines, and communication is performed by using the signal lines SG1, SG2 as communication lines. Accordingly, in the second embodiment, the air conditioning system constructed by an outdoor unit 12 and indoor units 22-1 to 22-n which can be adapted to any connection style shown in FIG. 1 or FIG. 7 will be described. The connection style shown in FIG. 1 is referred to as "three-line type" and the connection style shown in FIG. 7 is referred to as "4-wire type".

Figure 7:
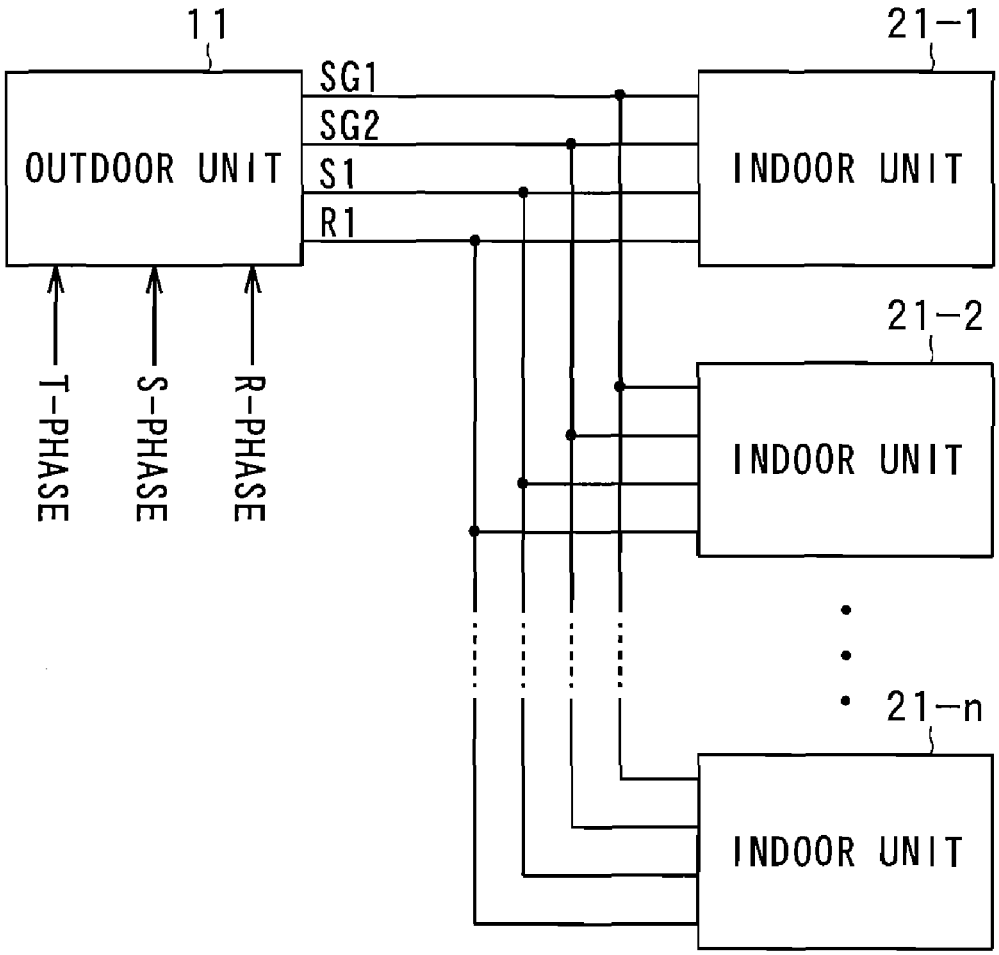
FIG. 7 is a diagram showing a 4-wire type wiring system.
Figure 8:
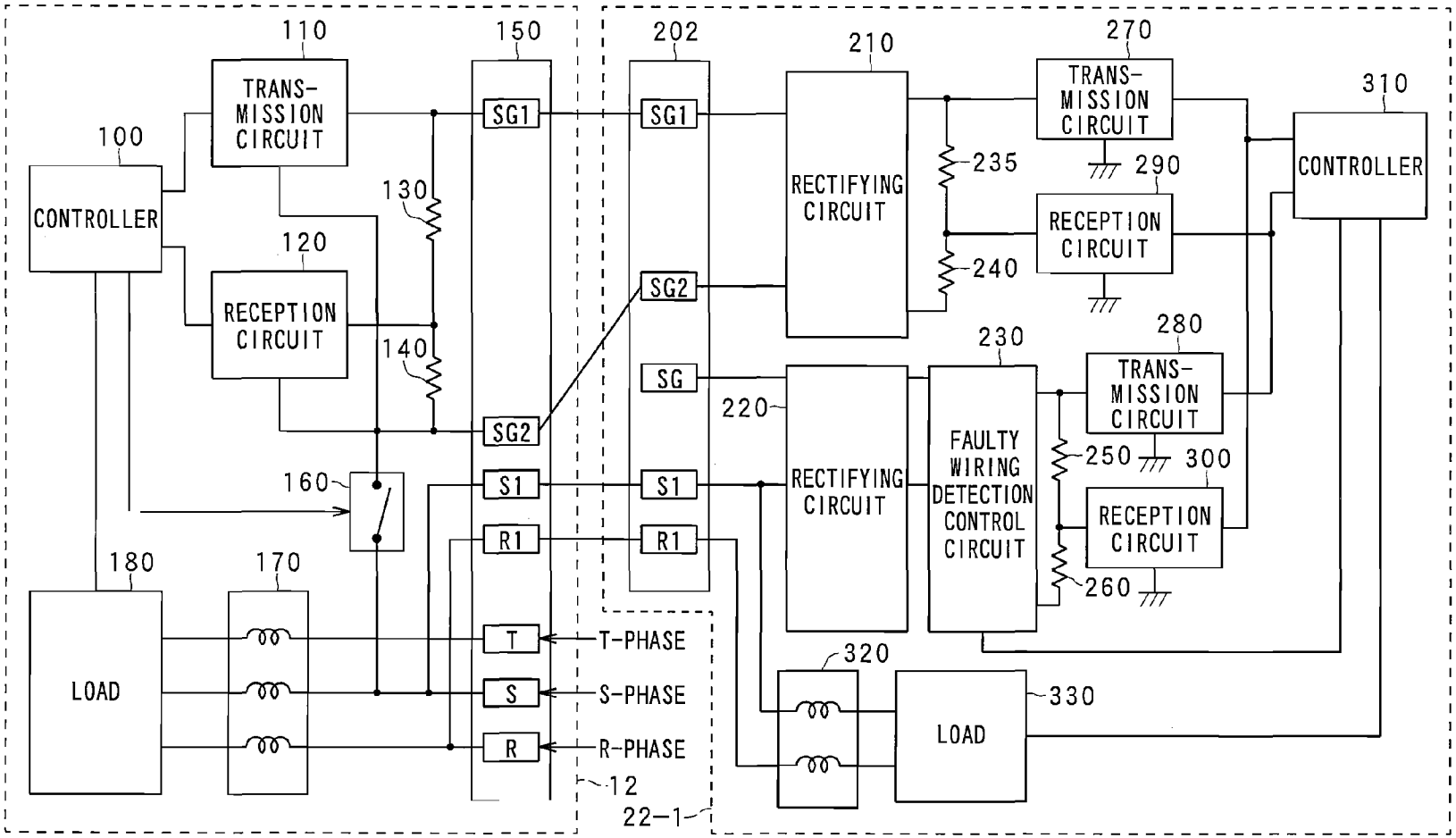
FIG. 8 is a block diagram showing an example of the construction of a second embodiment.
Figure 9:
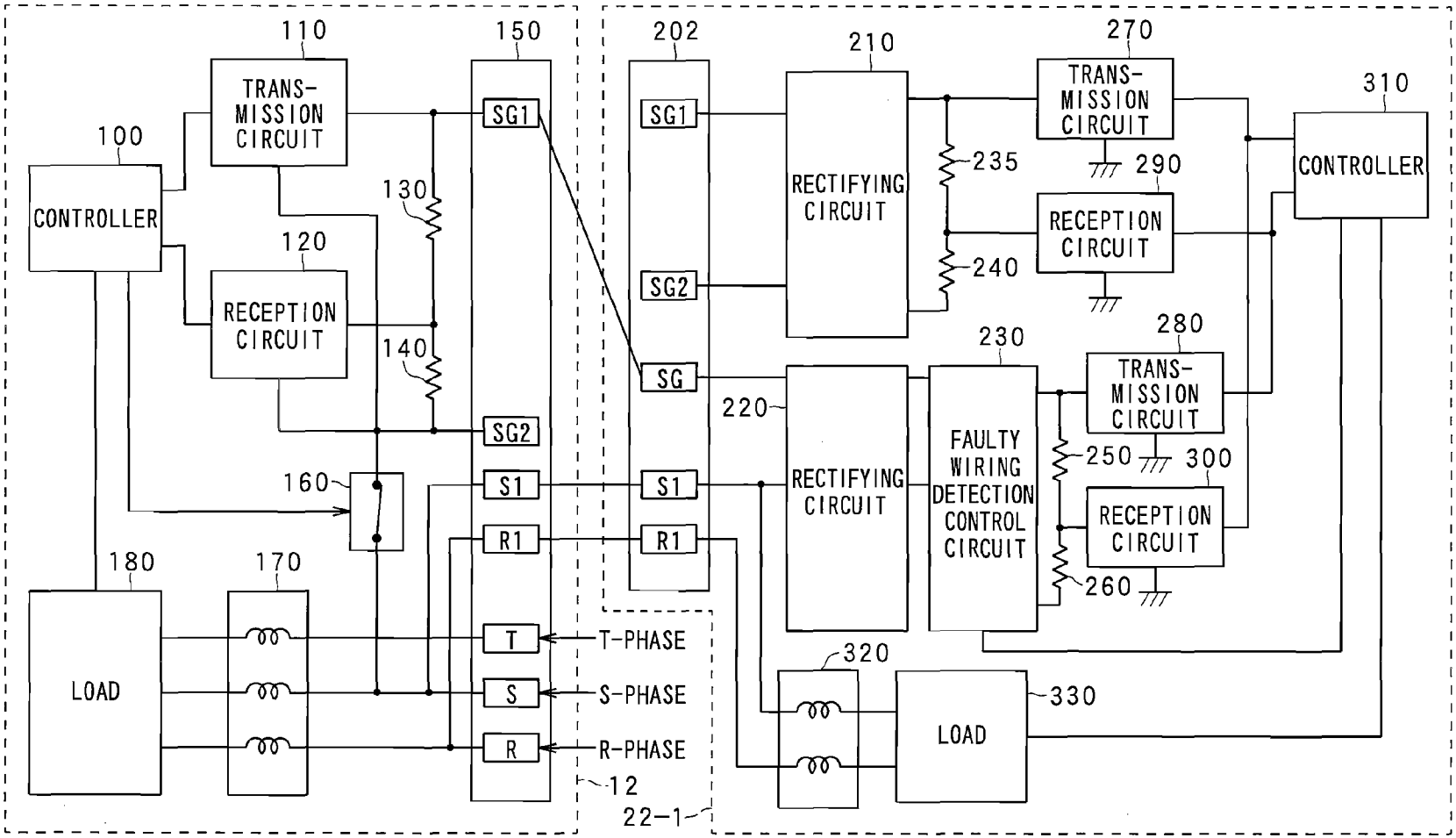
FIG. 9 is a block diagram showing an example of the construction of the second embodiment.

FIG. 8 is a diagram showing the construction of the outdoor unit 12 and the indoor unit 22-1 which are connected to each other by the 4-wire type wiring shown in FIG. 7. Furthermore, FIG. 9 is a diagram showing the construction of the outdoor unit 12 and the indoor unit 22-1 which are connected to each other by the 3-wire type wiring shown in FIG. 1. In FIGS. 8 and 9, the corresponding parts to those of FIG. 2 are represented by the same reference numerals, and the description thereof is omitted.

As compared with the case of FIG. 2, a switch 160 is added to the outdoor unit 12 in the second embodiment shown in FIGS. 8 and 9. Furthermore, with respect to the indoor unit 22-1, the terminal table 200 is replaced by a terminal table 202, and a rectifying circuit 210, resistors 235, 240, a transmission circuit 270 and a reception circuit 290 which correspond to a circuit for performing the 4-wire type communication. The other construction is the same as shown in FIG. 2.

Here, the switch 160 of the outdoor unit 12 is controlled by the controller 100, and connects/disconnects the grounds of the transmission circuit 110 and the reception circuit 120 to/from the S-phrase of the power supply line. More specifically, when the switch 160 is set to ON-state, the outdoor unit 12 is set to be adaptable to the 3-wire type communication, and when the switch 160 is set to OFF-state, the outdoor unit 12 is set to be adaptable to the 4-wire type communication.

Terminals SG1, SG2 adapted to the 4-wire type communication are added to the terminal table 202. More specifically, as shown in FIG. 8, the terminal SG1 of the terminal table 150 and the terminal SG1 of the terminal table 202 are connected to each other, and the terminal SG2 of the terminal table 150 and the terminal SG2 of the terminal table 202 are connected to each other, whereby the 4-wire type communication can be performed. Furthermore, as shown in FIG. 9, the terminal SG1 of the terminal table 150 and the terminal SG1 of the terminal table 202 are connected to each other, whereby the 3-wire type communication can be performed.

The rectifying circuit 210 is constructed, for example, by a bridge diode or the like, and rectifies the voltage appearing at (between) the terminals SG1 and SG2 or the voltage appearing between both the ends of the resistors 235 and 240. The resistors 235, 240 serve as input/output resistors for the transmission circuit 270 and the reception circuit 290. The transmission circuit 270 converts data supplied from the controller 310 to a serial signal, and outputs the serial signal to the resistors 235, 240. The reception circuit 290 subjects the signal voltage appearing at the resistor 24 to waveform shaping or the like, and supplies it to the controller 310. The detailed constructions of the transmission circuit 270 and the reception circuit 290 are the same as the transmission circuit 280 and the reception circuit 300 shown in FIG. 4.

Operation of Second Embodiment

The second embodiment of the present invention can be adapted to the 4-wire type communication by adopting the wiring system shown in FIG. 8 Furthermore, this embodiment can be adapted to the 3-wire type communication by adopting the wiring system shown in FIG. 9. Therefore, for example, the proper wiring system is adopted in accordance with the situation that the existing facilities are based on the 4-wire type or 3-wire type, whereby the outdoor unit 12 and the indoor unit 22-1 are newly added or the existing facilities are replaced by these units. That is, when the existing facilities are based on the 4-wire type, the wiring system shown in FIG. 8 is adopted, whereby the existing equipment (the outdoor unit or the indoor unit) is replaced by new equipment (the outdoor unit 12 or the indoor unit 22-1), or new equipment is added to the existing equipment.

When the installation of the facilities and the wiring are finished, the installation technician turns on the power of the outdoor unit 12. As a result, power supply of the power source to each part of the outdoor unit 12 is started, and also the power supply of the power source to the indoor units 22-1 to 22-n through the power supply lines S1, R1 is started. When the supply of the power to the outdoor units 12 is started, the controller 100 reads and executes the program stored in ROM (not shown). As a result, the processing of the flowchart shown in FIG. 10 is started.

Figure 10:
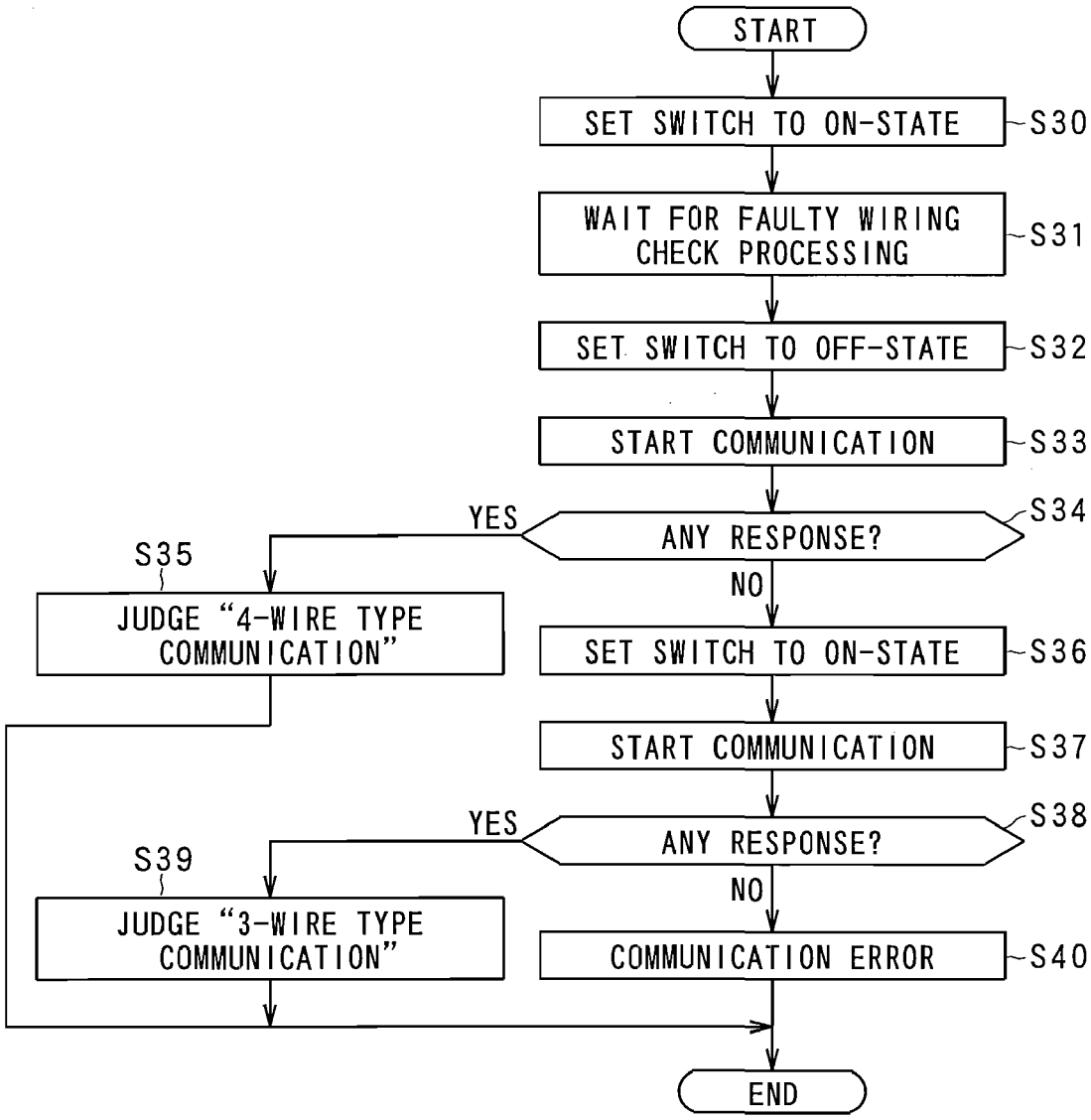
FIG. 10 is a flowchart executed in the outdoor unit shown in FIGS. 8 and 9.

When the processing of FIG. 10 is started, the controller 100 sets the switch 160 to ON-state in step S30. As a result, the ground of the transmission circuit 110 and the ground of the reception circuit 120 are connected to the power supply line S1, and the outdoor unit 12 is set to be adaptable to the 3-wire type communication. Subsequently, in step S31, the controller 100 is set to a waiting state for faulty wiring check processing. That is, in step S30, when the outdoor unit 12 is set to be adaptable to the 3-wire type communication and also the 3-wire type wiring shown in FIG. 9 is established, DC 24V is supplied to the indoor units 22-1 to 22-n. In the indoor unit 22-1 to 22-n, when the power supply of the power source is started, the processing shown in FIG. 5 is executed, and the presence or absence of faulty wiring is checked. In the processing of the step S31, a standby state is set for a predetermined time (for example, 10 seconds) in which the processing shown in FIG. 5 is finished in all the indoor units 22-1 to 22-n.

When the predetermined time elapses, the controller 100 goes to step S32, and sets the switch 160 to OFF-state. When the switch 160 is set to OFF-state, the outdoor unit 12 is set to be adaptable to the 4-wire type communication. Subsequently, the controller 100 starts the communication in step S33. That is, the controller 100 controls the transmission circuit 110 to transmit predetermined data. At this time, when the wiring system shown in FIG. 8 is adopted, the serial signal is supplied to the indoor units 22-1 to 22-n through the signal lines SG1 and SG2. In the indoor unit 22-1, this serial signal is received by the reception circuit 290, and supplied to the controller 310. The controller 310 recognizes that the predetermined data are received, and transmits predetermined data representing an acknowledge through the transmission circuit 270 to the outdoor unit 12. As a result, the serial signal is transmitted through the signal lines SG1, SG2, and the outdoor unit 12 receives this serial signal. The processing as described above is also executed in the indoor units 22-1 to 22-n.

In step S34, the controller 100 judges whether an acknowledge is made to the communication in step S33. As a result, if the acknowledge is made (step S34; Yes), the processing goes to step S35. In the other cases (step S34; No), the processing goes to step S36. For example, when the wiring system shown in FIG. 8 is adopted, an acknowledge is made from the indoor units 22-1 to 22-n, and thus the processing goes to step S35. On the other hand, when the wiring system shown in FIG. 9 is adopted, the switch 160 is set to OFF-state, and thus no acknowledge is made from the indoor units 22-1 to 22-n. Therefore, in this case, the processing goes to step S36.

In step S35, the controller 100 judges that the 4-wire type wiring is established, and keeps the switch 160 to OFF-state. As a result, when the wiring system shown in FIG. 8 is adopted, the switch 160 is kept to OFF-state, and thus the outdoor unit 12 is set to be adaptable to the 4-line type communication.

On the other hand, if it is judged in step S34 that there is no acknowledge, the processing goes to step S356, and the controller 100 sets the switch 160 to ON-state. As a result, the outdoor unit 12 is set to be adaptable to the 3-wire type communication. Then, the processing goes to step S37 to start the communication. At this time, when the wiring system shown in FIG. 9 is adopted, the serial signal transmitted from the transmission circuit 110 is transmitted to the indoor units 22-1 to 22-n. In each indoor unit, when there is no faulty wiring, the switch 234 is set to ON-state by the processing shown in FIG. 5, so that the reception circuit receives the serial signal. For example, in the indoor unit 22-1, the reception circuit 300 receives this serial signal, and supplies it to the controller 130. The controller 310 transmits a signal for acknowledge through the transmission circuit 280. As result, the serial signal is transmitted to the outdoor unit 12. In the outdoor unit 12, this signal is received by the reception circuit 120, and supplied to the controller 100. As a result, the controller 100 judges in step S38 that there is an acknowledge (step S38; Yes), and the processing goes to step S39. If there is no acknowledge (step S38; No), it is estimated that a communication error occurs and thus the processing goes to step S40.

In step S39, the controller 100 keeps the switch 160 to ON-state because it is estimated that the 3-wire type wiring is selected. As a result, the switch 160 is kept to ON-state, and the outdoor unit 12 is set to be adaptable to the 3-wire type communication. On the other hand, in step S40, it is impossible to perform communication in any of the 3-wire system and the 4-wire system, and thus it is judged that a communication error occurs. Accordingly, then controller 100 controls the display unit to display occurrence of a communication error and then finishes the processing.

As described above, in the second embodiment of the present invention, as in the case of the first embodiment, the voltage appearing at (between) the terminal SG and the terminal S1 of the terminal table 202 are detected by the photocoupler 233, and when the output voltage of the photocoupler 233 is equal to a predetermined threshold value or more, the switch 234 is prevented from being turned on. Accordingly, an excessive voltage can be prevented from being applied to the transmission circuit 280 and the reception circuit 300 due to faulty wiring, and thus these circuits can be prevented from being damaged.

Furthermore, in the second embodiment, after the switch 234 is set to ON-state, it is judge whether the communication is normal or not. If the communication is not normal, the display unit 340 is controlled to display this fact. Accordingly, it can be known that the present case may correspond to the case of "No. 3" shown in FIG. 6. Therefore, the installation technician can known the probability of faulty wiring.

Still furthermore, in the second embodiment, a switch which is set to ON-state when a driving signal is supplied from the controller 310 is used as the switch 234. Accordingly, when no normal driving signal is supplied from the controller 310, the switch is set to OFF-state at all times, and thus a high voltage can be prevented from being erroneously applied to the transmission circuit 280 and the reception circuit 300. Particularly, in the cases of "No. 5" and "No. 6" shown in FIG. 6, the controller 310 does not operate, but even in these cases, the switch 234 is kept to OFF-state, and thus a high voltage can be prevented from being erroneously applied to the transmission circuit 280 and the reception circuit 300.

According to the second embodiment, in the processing shown in FIG. 10, after the switch 160 is set to ON-state in step S30, the detection processing of faulty wiring is executed. Accordingly, when the 3-wire system is adopted, the switch 234 is set to ON-state after it is checked that no faulty wiring occurs. Therefore, when the 3-wire system is adopted and faulty wiring occurs, the transmission circuit 280 and the reception circuit 300 can be prevented from being damaged.

In the above embodiments, in consideration of the case where the 3-wire system is adopted, the switch 160 is set to ON-state in step S30, and it is awaited in step S31 that the processing shown in FIG. 5 is executed in the indoor units 22-1 to 22-n. However, the processing of the steps S30 and S31 may be omitted, and the execution of the processing of FIG. 5 may be awaited until the switch 160 is set to ON-state in the indoor units 22-1 to 22-n. More specifically, with respect to the processing of FIG. 10, the steps S30 and S31 are omitted, and the processing is executed from the step S32. In this case, when the 3-wire type wiring is adopted, it is impossible to perform communication, and thus "No" is judged in step S34, so that the processing goes to step S36. As a result, the switch 160 is set to ON-state in step S36, and thus the processing shown in FIG. 5 is executed in the indoor units 22-1 to 22-1n. At this time, the outdoor unit 12 is set to a standby state. When the processing of FIG. 5 is executed, the switches 234 of the indoor units 22-1 to 22-n are set to ON-state if no faulty wiring occurs. The outdoor unit 12 releases the standby state, and shifts to the processing of step S37 to judge whether it is possible to perform communication. As a result, when the communication is normally performed, the processing goes to step S39, whereby the 3-line type communication can be performed.

(E) Modification

The present invention is not limited to the above embodiments, and various modifications and applications may be freely performed within the scope of the present invention.

For example, the circuit construction shown in FIGS. 3 and 4 is an example, and thus other circuit constructions may be adopted.

Furthermore, in the above-described embodiments, the voltage appearing between the terminals SG and S1 is divided by the resistors 231 and 232, and the divided voltage is detected by the photocoupler 233. The output voltage of the photocoupler 233 is read in and processed by the controller 310. However, for example, the voltage between the terminals SG and S1 may be directly detected without using the resistors 231 and 232, the voltage may be directly detected without using the photocoupler 233, or the switch 234 may be directly controlled in accordance with the output of the photocoupler 233 by an analog circuit without using controller 310. Furthermore, the electromagnetic relay is used as the switch 234, however, a semiconductor switch or the like may be used as the switch 234.

Still furthermore, in the above-described embodiments, the switch 160 is automatically set. However, the switch 160 may be designed as a manual switch, and the installation technician may manually set the switch 160. For example, when the 3-wire system is selected, the manual switch is set to ON-state, and when the 4-wire system is selected, the manual switch is set to OFF-state. According to this method, new equipment can be added or exchanged irrespective of the state of the existing facilities, and normal communication can be performed.

Still furthermore, in the above-described embodiments, the construction based on the outdoor unit 10 and the indoor units 20-1 to 20-n or the construction based on the outdoor unit 10 and the indoor units 22-1 to 22-n is adopted. However, a central control unit and an interface device may be added as occasion demands. Furthermore, only one outdoor unit may be provided, or two or more outdoor units may be provided.

Still furthermore, in the second embodiment, the outdoor unit 12 is provided with the function of automatically detecting the communication system with the switch 160. However, the indoor unit 22-1 shown in FIGS. 8 and 9 may be connected to an outdoor unit which is not provided with the function as described above. In this case, for example, if the outdoor unit adopts the 4-wire system, the wiring method shown in FIG. 8 is adopted. If the outdoor unit adopts the 3-wire system, the wiring method shown in FIG. 9 may be adopted. According to this modification, the indoor unit can be additionally provided or replaced irrespective of the type of the existing outdoor unit.

Thus, while there have been shown, described, and pointed out fundamental novel features of the invention as applied to several embodiments, it will be understood that various omissions, substitutions, and changes in the form and details of the illustrated embodiments, and in their operation, may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

I claim:

1. An air conditioning system comprising:

an outdoor unit and an indoor unit connected to each other through common power supply lines, wherein the outdoor unit includes a first communication circuit configured to perform communication by using, as communication lines, at least one of the power supply lines and at least one signal line independent of the power supply lines, and the indoor unit includes:

a pair of terminals to which the communication lines from the first communication circuit are connected;

a second communication circuit that is connected to the pair of terminals, and which communicates with the first communication circuit over the at least one power supply line and the at least one signal line independent of the power supply lines;

a switch configured to set the first communication circuit and the second communication circuit to a connection state or a disconnection state;

a detection circuit configured to detect a voltage appearing between the pair of terminals, and to detect faulty wiring between the at least one power supply line and the at least one signal line connected between the first communication circuit and the second communication circuit on the basis of a detected voltage;

a controller configured to control the switch to set the first communication circuit and the second communication circuit to the disconnection state when an occurrence of faulty wiring is estimated, the occurrence of faulty wiring being estimated when the voltage detected by the detection circuit is equal to or more than a predetermined threshold value, and the controller further configured to control the switch to otherwise set the first communication circuit and the second communication circuit to the connection state; and a judging circuit configured to judge whether communication can be performed between the outdoor unit and the indoor unit when the controller controls the switch to set the first and second communication circuits to the connection state, and detecting faulty wiring between the at least one power supply line and the at least one signal line connected between the first communication circuit and the second communication circuit on the basis of a communication result between the first communication circuit and the second communication circuit.

2. The air conditioning system according to claim 1, wherein the indoor unit further comprises a presentation circuit configured to display a detection result of the detection circuit and a judgment result of the judging circuit.

3. The air conditioning system according to claim 1, wherein the switch is configured to set the first and second communication circuits to the connection state when no driving voltage is applied from the controller, and is further configured to set the first and second communication circuits to the disconnection state when a driving voltage is applied from the controller.

4. An indoor unit of an air conditioning system connected through common power supply lines to an outdoor unit of the air conditioning system having a first communication circuit which communicates with the indoor unit by using as communication lines one of the power supply lines and one signal line independent of the power supply lines, the indoor unit comprising:

a pair of terminals to which the communication lines from the first communication circuit are connected;

a second communication circuit that is connected to the pair of terminals and which communicates with the first communication circuit over the at least one power supply line and the at least one signal line independent of the power supply lines;

a switch configured to set the first communication circuit and the second communication circuit to a connection state or a disconnection state;

a detection circuit configured to detect a voltage appearing between the pair of terminals; and a controller configured to control the switch to set the first communication circuit and the second communication circuit to the connection state when the voltage detected by the detection circuit is equal to or greater than a predetermined threshold value; and the controller further configured to control the switch to set the first communication circuit and the second communication circuit to the disconnection state when the detection voltage is less than the predetermined threshold.

* * * * *